US008080509B2

(12) United States Patent
Magennis et al.

(10) Patent No.: US 8,080,509 B2
(45) Date of Patent: Dec. 20, 2011

(54) LOW-BUILDER, HIGHLY WATER-SOLUBLE, LOW-DENSITY SOLID LAUNDRY DETERGENT COMPOSITION

(75) Inventors: Euan John Magennis, Tynemouth (GB); Alan Thomas Brooker, Newcastle upon tyne (GB); Andrew Philip Davie, Newcastle upon Tyne (GB); Doris Appleby, Newcastle upon Tyne (GB); Maria Papadaki, Kraainem (BE); Sylvain Andre Sorin, Braine l'Alleud (BE); Paul Andrzej Luksza, Newcastle upon Tyne (GB); Nigel Patrick Somerville Roberts, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 118 days.

(21) Appl. No.: 11/974,841

(22) Filed: Oct. 16, 2007

(65) Prior Publication Data

US 2008/0269099 A1 Oct. 30, 2008

(30) Foreign Application Priority Data

Oct. 16, 2006 (EP) ..... 06021615

(51) Int. Cl.
*C11D 17/06* (2006.01)
*C11D 3/10* (2006.01)
*C11D 3/395* (2006.01)

(52) U.S. Cl. ..... 510/276; 510/357; 510/438; 510/443; 510/444; 510/452; 510/302

(58) Field of Classification Search ..... 510/276, 510/357, 438, 443, 444, 451, 452, 302
See application file for complete search history.

(56) References Cited

U.S. PATENT DOCUMENTS

| | | | | |
|---|---|---|---|---|
| 5,462,804 | A * | 10/1995 | Kokubu et al. | 428/402.24 |
| 5,726,142 | A | 3/1998 | Partee et al. | |
| 5,756,445 | A | 5/1998 | Dorset et al. | |
| 6,221,831 | B1 | 4/2001 | Emery et al. | |
| 6,235,704 | B1 * | 5/2001 | Detering et al. | 510/480 |
| 6,339,055 | B1 * | 1/2002 | Brooker et al. | 510/301 |
| 6,369,015 | B1 | 4/2002 | Groot et al. | |
| 6,610,645 | B2 * | 8/2003 | Pancheri et al. | 510/509 |
| 6,936,577 | B2 | 8/2005 | Dontula et al. | |
| 2006/0035802 | A1 * | 2/2006 | Brooker et al. | 510/445 |
| 2006/0189501 | A1 * | 8/2006 | Lant et al. | 510/392 |
| 2006/0189505 | A1 * | 8/2006 | Muller et al. | 510/446 |
| 2007/0037726 | A1 * | 2/2007 | Brooker et al. | 510/476 |
| 2007/0042927 | A1 * | 2/2007 | Muller et al. | 510/444 |
| 2007/0042928 | A1 * | 2/2007 | Appleby et al. | 510/444 |
| 2007/0042932 | A1 * | 2/2007 | Appleby et al. | 510/447 |
| 2007/0197423 | A1 * | 8/2007 | Lant et al. | 510/511 |
| 2008/0045435 | A1 * | 2/2008 | Somerville Roberts et al. | 510/446 |
| 2008/0214425 | A1 * | 9/2008 | Lant et al. | 510/300 |

FOREIGN PATENT DOCUMENTS

| | | | |
|---|---|---|---|
| EP | 1416039 | A1 | 5/2004 |
| EP | 1416040 | A1 | 5/2004 |
| EP | 1690921 | A1 | 8/2006 |
| EP | 1690922 | A1 | 8/2006 |
| WO | WO 93/02168 | A | 2/1993 |
| WO | WO 0039261 | A1 | 7/2000 |
| WO | WO 03/038028 | A2 | 5/2003 |
| WO | WO 2005/083046 | A1 | 9/2005 |
| WO | WO 2005/083048 | A1 | 9/2005 |
| WO | WO 2005/083049 | A3 | 9/2005 |
| WO | WO 2006/020788 | A1 | 2/2006 |
| WO | WO 2006/020789 | A1 | 2/2006 |
| WO | WO 2006/088665 | A1 | 8/2006 |
| WO | WO 2006/088666 | A1 | 8/2006 |

* cited by examiner

*Primary Examiner* — Lorna M Douyon
(74) *Attorney, Agent, or Firm* — Julie A. McConihay; Leonard W. Lewis; Steven W. Miller

(57) ABSTRACT

The present invention relates to a solid laundry detergent composition having a bulk density of from 100 g/l to 500 g/l, wherein the composition comprises: (a) from 1 wt % to 70 wt % anionic detersive surfactant; (b) from 0 wt % to 10 wt % zeolite builder; and (c) from 0 wt % to 10 wt % phosphate builder; wherein the composition comprises: (I) from 61 wt % to 90 wt % low-density particulate component, wherein the low-density particulate component has a bulk density of from 100 g/l to 426 g/l, and wherein the low-density particulate component comprises inorganic material and organic material; and (II) from 10 wt % to 39 wt % high-density particulate component, wherein the high-density particulate component has a bulk density of greater than 426 g/l; wherein the ratio of (i) the weight ratio of the inorganic material to the organic material comprised in the low-density particulate component (I) to (ii) the weight ratio of the inorganic material to the organic material comprised in the solid laundry detergent composition is from 0.3:1 to 5:1.

16 Claims, No Drawings

LOW-BUILDER, HIGHLY WATER-SOLUBLE, LOW-DENSITY SOLID LAUNDRY DETERGENT COMPOSITION

FIELD OF THE INVENTION

The present invention relates to low-builder, highly water-soluble low-density solid laundry detergent compositions. The compositions of the present invention exhibit reduced susceptibility to under- or over-dosing by the consumer, thereby providing more consistent cleaning performance irrespective of the dosage of the composition. The compositions of the present also provide good overall cleaning performance, especially good stain-removal performance and whiteness maintenance performance, especially under stressed conditions such as in the presence of high soil or high water hardness. Furthermore, the compositions exhibit superior dissolution rates and quickly form relatively transparent wash liquors upon contact with water. The compositions of the present invention are especially effective in cold water washing temperatures: such as 20° C. or lower.

BACKGROUND OF THE INVENTION

In recent years, the manufacturers of solid laundry detergent products have focused their efforts into formulating water-soluble laundry detergent compositions that exhibit a good cleaning performance and a good dissolution performance in water. Some examples of these efforts are described in: DE19912679 and WO03/038028, both by Henkel KGaA; EP1416039 and EP1416040, both by Dalli-Werke Wasche und Korperflege GmbH & Co. KG; and WO05/083046, WO05/083048, WO05/083049, WO06/020788, WO06/020789, WO06/088665, WO06/088666, EP1690921 and EP1690922 all by The Procter & Gamble Company.

However, the Inventors have found that water-soluble laundry detergent compositions are susceptible to significant variations in their cleaning performance depending on the dosage used by the consumer during the laundering process, especially under conditions such as soft water and low wash water temperatures, and especially when the detergent composition comprises bleach and/or polymer. Due to the difficulty of accurate dosing, consumers often significantly under- or over-dose their laundry detergent products during the laundering process. Therefore, there remains a need for a solid laundry detergent composition that is highly water-soluble and consistently delivers an excellent cleaning performance, especially an excellent stain-removal performance and whiteness maintenance performance, across a wide range of dosage habits.

SUMMARY OF THE INVENTION

The Inventors have overcome the above problem of dosage susceptibility by providing a solid laundry detergent composition according to the embodiments described herein.

DETAILED DESCRIPTION OF THE INVENTION

Solid laundry detergent composition: The solid laundry detergent composition typically has a bulk density of from 100 g/l to 700 g/l, or preferably from 100 g/l, or from 150 g/l, or from 200 g/l, or from 250 g/l, or from 300 g/l, or even from 350 g/l and preferably to 600 g/l, or to 550 g/l, or to 500 g/l, or to 450 g/l, or to 425 g/l, or even to 400 g/l. The method for determining the bulk density of the composition is described in more detail below.

The composition comprises a low-density particulate component and a high-density particulate component. Typically, preferably essentially, the low-density particulate component and the high-density particulate component are not co-granulated together to form a co-granule but instead preferably remain in the form of separate discrete populations of particles in the composition. Preferably, the low-density particulate component consists essentially only of one separate discrete population of homogenous low-density particles, whereas preferably the high-density particulate component comprises two or more separate discrete populations of homogeneous high-density particles. The low-density particulate component and high-density particulate component are described in more detail below.

The composition typically comprises anionic detersive surfactant and typically, or even preferably, comprises other detergent ingredients. The anionic detersive surfactant and the other detergent ingredients are described in more detail below.

Preferably, the composition comprises less than 15 wt % citric acid or salts thereof, preferably from 0 wt % to 10 wt %, or even to 8 wt % citric acid or salts thereof.

Low-density particulate component: The composition typically comprises from 40 wt % to 99 wt % low-density particulate component, preferably from 50 wt %, or from 61 wt %, or from 65 wt %, or from 70 wt %, or even from 75 wt %, and preferably to 95 wt %, or to 90 wt %, or to 85 wt %, or even to 80 wt % low-density particulate component.

The low-density particulate component typically has a bulk density of from 100 g/l to 426 g/l, preferably to 400 g/l, or to 300 g/l or even to 200 g/l. The method for determining the bulk density of the low-density particulate component is described in more detail below.

The low-density particulate component typically comprises inorganic material and organic material. The inorganic material and the organic material are described in more detail below.

The low-density particulate component may comprise an anionic detersive surfactant, preferably an alkyl benzene sulphonate anionic detersive surfactant. It may also be preferred that the low-density particulate component comprises less than 10 wt %, preferably less than 5 wt %, or even less than 2 wt % ethoxylated alcohol sulphate anionic detersive surfactant having an average ethoxylation degree of from 1 to 10; this is especially preferred when the low-density particulate component comprises an alkyl benzene sulphonate. It may even be preferred for the low-density particulate component to be essentially free from ethoxylated alcohol sulphate anionic detersive surfactant having an average ethoxylation degree of from 1 to 10. By essentially free from ethoxylated alcohol sulphate anionic detersive surfactant having an average ethoxylation degree of from 1 to 10 it is typically meant that the composition comprises no deliberately added ethoxylated alcohol sulphate anionic detersive surfactant having an average ethoxylation degree of from 1 to 10. This is especially preferred in order to ensure that the low-density particulate component has a good flowability profile and is not sticky.

The low-density particulate component typically comprises at least three, preferably at least four or even at least five detergent ingredients. The low-density particulate component is typically formed by spray-drying these detersive ingredients in a spray-drying tower to form a population of homogenous spray-dried particles that comprise at least three, preferably at least four or even five detergent ingredients. Preferably, the low-density particulate component is in spray-dried form. The low-density particulate component may be further admixed with liquid and/or solid detergent ingredients but typically, preferably essentially, it is not co-granulated with any other solid detergent ingredient. An admixing process step and a co-granulation process step are described in more detail below.

For the purpose of the present invention, the processing step of mixing a low-density particulate component, especially a low-density particulate component in spray-dried form, with one or more liquid and/or solid detergent ingredients that typically occurs during the process to make a solid laundry detergent composition is not a co-granulation process step because the weight average particle size of the low-density particulate component does not increase by at least 5% from its original size. Furthermore, for the purpose of the present invention, the processing step of mixing a low-density particulate component, especially a low-density particulate component in spray-dried form, with one or more smaller particle sized particulate flow aids (typically known as: "dusting" by the detergent industry), is not a co-granulation process step because the weight average particle size of the low-density particulate component does not increase by at least 5% from its original size. In these typical processes, the low-density particulate component is not considered to have been co-granulated.

Typically, the low-density particulate component has a particle size distribution such that at least 60 wt %, preferably at least 70 wt %, or at least 80 wt % has a particle size in the range of from 150 micrometers to 1400 micrometers.

High-density particulate component: The composition comprises from 1 wt % to 50 wt % high-density particulate component, preferably from 5 wt %, or from 10 wt %, or from 15 wt %, or from 20 wt %, or even from 25 wt % and preferably to 39 wt %, or to 35 wt %, or even to 30 wt % high-density particulate component.

The high-density particulate component has a bulk density of greater than 426 g/l or greater than 500 g/l, or greater than 600 g/l, or greater than 700 g/l, or greater than 800 g/l, or greater than 900 g/l, or even greater than 1,000 g/l. The method for determining the bulk density of the high-density particulate component is described in more detail below.

The high-density particulate component typically comprises inorganic material and organic material. The inorganic material and the organic material are described in more detail below.

The high-density particulate component preferably comprises an anionic detersive surfactant, most preferably an ethoxylated alcohol sulphate anionic detersive surfactant having an average degree of ethoxylation of from 1 to 10. It may be preferred that the high-density particulate component comprises less than 10 wt %, preferably less than 5 wt %, or even less than 2 wt % alkyl benzene sulphonate anionic detersive surfactant; this is especially preferred when the high-density particulate component comprises an ethoxylated alcohol sulphate anionic detersive surfactant having an average degree of ethoxylation of from 1 to 10. It may even be preferred for the high-density particulate component to be essentially free from alkyl benzene sulphonate anionic detersive surfactant. By essentially free alkyl benzene sulphonate anionic detersive surfactant it is typically meant that the composition comprises no deliberately added alkyl benzene sulphonate anionic detersive surfactant. This is especially preferred in order to ensure that the composition has a good dispensing performance, and to avoid the formation of macromolecular gel phases during dissolution in water.

The high-density particulate component may also comprise detergent ingredients such as sodium percarbonate, polymeric carboxylates, enzymes, bleach activators such as tetraacetylethylenediamine, sulphate salts, carbonate salts and aesthetic ingredients. Preferably, the high-density particulate component comprises sodium percarbonate, most preferably a sodium percarbonate that is at least partially, preferably essentially completely, coated by a coating material. Most preferably, the high-density particulate component comprises at least two, preferably at least three, or at least four, or even at least five separate discrete populations of homogeneous high-density particles. The first particle population preferably comprises an ethoxylated alcohol sulphate anionic detersive surfactant having an average degree of ethoxylation of from 1 to 10, and the second particle population comprises, preferably consists essentially only of sodium percarbonate, preferably sodium percarbonate that is at least partially, preferably essentially completely, coated by a coating material.

The high-density particulate component is typically in the form of an agglomerate, an extrudate, a flake, a noodle, a needle, a prill or a high-density spray-dried particle, or a mixture thereof, preferably an extrudate or an agglomerate, most preferably an agglomerate. The high-density particulate component typically comprises one or more detersive ingredients. These detersive ingredients may have been subjected to a spray-drying step at some stage during their preparation, however, when these materials are incorporated into the high-density particulate component they are typically co-granulated with at least one other detergent ingredient, preferably at least one solid detergent ingredient, in a process that does not include a spray-drying step. Such non-spray-drying processes include agglomeration processes, extrusion processes, and/or roller compaction processes. Typically, preferably essentially, the high-density particulate component either: (i) consists essentially only of one or more detergent ingredients, preferably one or more solid detergent ingredients, that have not been subjected to a spray-drying process at any stage during their process of manufacture; or (ii) comprises two or more detergent ingredients, preferably two or more solid detergent ingredients, that may have been subjected to a spray-drying process step during their process of manufacture but if they have been subjected to a spray-drying process, then they are subsequently co-granulated with at least one other detergent ingredient, preferably at least one other solid detergent ingredient, in a process that does not involve a spray-drying process step.

Inorganic material: For the purpose of the present invention, inorganic material is defined as any material that does not comprise a hydrocarbon moiety. Examples of inorganic material include sodium carbonate and sodium sulphate.

Organic material: For the purpose of the present invention, organic material is defined as any material that comprises a hydrocarbon moiety. For the purpose of the present invention, a hydrocarbon moiety comprises a carbon atom that is covalently bonded to a hydrogen atom: i.e. having the general formula:

C—H

Examples of organic material include alkyl benzene sulphonate and citric acid.

Inorganic material to organic material ratio: The ratio of (i) the weight ratio of the inorganic material to the organic material comprised in the low-density particulate component to (ii) the weight ratio of the inorganic material to the organic material comprised in the solid laundry detergent composition is from 0.1 to 10:1, preferably from 0.2, or from 0.3, and preferably to 5:1, or to 4:1, or to 3:1, or to 2:1, or to 1:1, or to 0.9:1, or to 0.8:1, or to 0.7:1, or to less than 0.6:1, or to 0.55:1, or even to 0.5:1. This is especially preferred to ensure that the composition delivers an excellent cleaning performance, especially an excellent stain-removal performance and whiteness maintenance performance, across a wide range of dosage habits.

Preferably, the weight ratio (i) of the inorganic material to the organic material comprised in the low-density particulate component is in the range of from 0.1:1 to 10:1, preferably from 0.2:1, or even from 0.3:1, and preferably to 5:1, or to 3:1, or to 1.5:1, or to 1.2:1, or to 1.0:1, or to 0.8:1, or even to 0.5:1. Preferably, the weight ratio (ii) of the inorganic material to the organic material comprised in the solid laundry detergent composition is in the range of from 0.1:1 to 10:1, preferably from 0.2:1, or even from 0.3:1, and preferably to 5:1, or to 3:1, or to 1.5:1, or to 1.4:1. or to 1.2:1, or to 1.0:1, or to 0.8:1, or even to 0.5:1.

Anionic detersive surfactant: The composition comprises from 1 wt % to 70 wt % anionic detersive surfactant, preferably from 2 wt %, or from 5 wt %, or from 7 wt %, or even from 10 wt %, and preferably to 60 wt %, or to 50 wt %, or to 40 wt %, or even to 30 wt % anionic detersive surfactant. Suitable anionic detersive surfactants are alkoxylated alcohol sulphate anionic detersive surfactants such as linear or branched, substituted or unsubstituted ethoxylated $C_{12-18}$ alcohol sulphates having an average degree of ethoxylation of from 1 to 10, preferably from 3 to 7. Other suitable anionic detersive surfactant are alkyl benzene sulphonate anionic detersive surfactants such as linear or branched, substituted or unsubstituted $C_{8-18}$ alkyl benzene sulphonates, preferably linear unsubstituted $C_{10-13}$ alkyl benzene sulphonates. Other suitable anionic detersive surfactants are alkyl sulphates, alkyl sulphonates, alkyl phosphates, alkyl phosphonates, alkyl carboxylates or any mixture thereof.

Zeolite builder: The composition comprises from 0 wt % to 10 wt % zeolite builder, preferably to 8 wt %, or to 6 wt %, or to 5 wt %, or to 4 wt % or to 2 wt % zeolite builder. It may even be preferred for the composition to be essentially free from zeolite builder. By essentially free from zeolite builder it is typically meant that the composition comprises no deliberately added zeolite builder. This is especially preferred if it is desirable for the composition to be very highly water-soluble, to minimize the amount of water-insoluble residues (for example, which may deposit on fabric surfaces), and also when it is highly desirable to have a transparent wash liquor. Zeolite builders include zeolite A, zeolite X, zeolite P and zeolite MAP.

Phosphate builder: The solid laundry detergent composition comprises from 0 wt % to 10 wt % phosphate builder, preferably to 8 wt %, or to 6 wt %, or to 5 wt %, or to 4 wt % or to 2 wt % phosphate builder. It may even be preferred for the composition to be essentially free from phosphate builder. By essentially free from phosphate builder it is typically meant that the composition comprises no deliberately added phosphate builder. This is especially preferred if it is desirable for the composition to have a very good environmental profile. Phosphate builders include sodium tripolyphosphate.

Silicate salt: The solid laundry detergent composition preferably comprises from 0 wt % to 10 wt % silicate, preferably to 8 wt %, or 6 wt %, or to 4 wt % or to 2 wt % silicate salt. It may even be preferred for the composition to be essentially free from silicate salt. By essentially free from silicate salt it is typically meant that the composition comprises no deliberately added silicate salt. This is especially preferred in order to ensure that the composition has a very good dispensing and dissolution profiles and to ensure that the composition provides a clear wash liquor upon dissolution in water. Silicate salts include water-insoluble silicates. Silicate salts include amorphous silicates and crystalline layered silicates (e.g. SKS-6). A typical silicate salt is sodium silicate.

Other detergent ingredients: The composition typically comprises detergent ingredients. Suitable detergent ingredients include: detersive surfactants such as anionic detersive surfactants, non-ionic detersive surfactants, cationic detersive surfactants, zwitterionic detersive surfactants, amphoteric detersive surfactants; preferred non-ionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating material such as a carbonate salt, a sulphate salt, a silicate salt, especially borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; carbonate salts, preferably sodium carbonate and/or sodium bicarbonate, preferably sodium carbonate; polymeric carboxylates, preferably co-polymers of maleic acid and acrylic acid and salts thereof, and polyacrylates; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; citric acid or salts thereof; and dyes.

Preferably, the composition comprises less than 1 wt % chlorine bleach and less than 1 wt % bromine bleach. Preferably, the composition is essentially free from bromine bleach and chlorine bleach. By "essentially free from bromine bleach and chlorine bleach" it is typically meant comprises no deliberately added bromine bleach and chlorine bleach.

Admixing process step: For the purpose of the present invention, an admixing process step is defined as a process step wherein a solid particulate component is contacted with another material in such a manner so that the weight average particle size of the solid particulate component increases by less than 5% from its original size.

Co-granulation process step: For the purpose of the present invention, a co-granulation process step is defined as a process step wherein a solid particulate component is contacted with another material in such a manner so that the weight average particle size of the solid particulate component increases by at least 5% from its original size.

Method for determining the bulk density of the spray-dried powder: The bulk density is typically determined by the following method:

Summary: A 500 ml graduated cylinder is filled with a powder, the weight of the sample is measured and the bulk density of the powder is calculated in g/l.

Equipment:

1. Balance. The balance has a sensitivity of 0.5 g.
2. Graduated cylinder. The graduated cylinder has a capacity 500 ml. The cylinder should be calibrated at the 500 ml mark, by using 500 g of water at 20° C. The cylinder is cut off at the 500 ml mark and ground smooth.
3. Funnel. The funnel is cylindrical cone, and has a top opening of 110 mm diameter, a bottom opening of 40 mm diameter, and sides having a slope of 76.4° to the horizontal.
4. Spatula. The spatula is a flat metal piece having of a length of at least 1.5 times the diameter of the graduated cylinder.
5. Beaker. The beaker has a capacity of 600 ml.
6. Tray. The tray is either a metal or plastic square, is smooth and level, and has a side length of at least 2 times the diameter of the graduated cylinder.
7. Ring stand.
8. Ring clamp.
9. Metal gate. The metal gate is a smooth circular disk having a diameter of at least greater than the diameter of the bottom opening of the funnel.

Conditions: The procedure is carried out indoors at conditions of 20° C. temperature, $1\times10^5 Nm^{-2}$ pressure and a relative humidity of 25%.

Procedure:

1. Weigh the graduated cylinder to the nearest 0.5 g using the balance. Place the graduated cylinder in the tray so that it is horizontal with the opening facing upwards.
2. Support the funnel on a ring clamp, which is then fixed to a ring stand such that the top of the funnel is horizontal and rigidly in position. Adjust the height of the funnel so that its bottom position is 38 mm above the top centre of the graduated cylinder.
3. Support the metal gate so as to form an air-tight closure of the bottom opening of the funnel.
4. Completely fill the beaker with a 24 hour old powder sample and pour the powder sample into the top opening of the funnel from a height of 2 cm above the top of the funnel.
5. Allow the powder sample to remain in the funnel for 10 seconds, and then quickly and completely remove the metal gate so as to open the bottom opening of the funnel and allow the powder sample to fall into the graduated cylinder such that it completely fills the graduated cylinder and forms an overtop. Other than the flow of the powder sample, no other external force, such as tapping, moving, touching, shaking, etc, is applied to the graduated cylinder. This is to minimize any further compaction of the powder sample.
6. Allow the powder sample to remain in the graduated cylinder for 10 seconds, and then carefully remove the overtop using the flat edge of the spatula so that the graduated cylinder is exactly full. Other than carefully removing the overtop, no other external force, such as tapping, moving, touching, shaking, etc, is applied to the graduated cylinder. This is to minimize any further compaction of the powder sample.
7. Immediately and carefully transfer the graduated cylinder to the balance without spilling any powder sample. Determine the weight of the graduated cylinder and its powder sample content to the nearest 0.5 g.
8. Calculate the weight of the powder sample in the graduated cylinder by subtracting the weight of the graduated cylinder measured in step 1 from the weight of the graduated cylinder and its powder sample content measured in step 7.
9. Immediately repeat steps 1 to 8 with two other replica powder samples.
10. Determine the mean weight of all three powder samples.
11. Determine the bulk density of the powder sample in g/l by multiplying the mean weight calculated in step 10 by 2.0.

EXAMPLES

Example 1

A Solid Laundry Detergent Composition and Process of Making It

Aqueous slurry composition.

| Component | % w/w Aqueous slurry |
|---|---|
| Linear alkyl benzene sulphonate | 10.6 |
| Acrylate/maleate copolymer | 4.6 |
| Ethylenediamine disuccinic acid and/or Hydroxyethane di(methylene phosphonic acid) | 1.4 |
| Sodium carbonate | 19.4 |
| Sodium sulphate | 28.6 |
| Water | 34.0 |
| Miscellaneous, such as magnesium sulphate, brightener, and one or more stabilizers | 1.4 |
| Total Parts | 100.00 |

Preparation of a Spray-dried Powder.

An aqueous slurry having the composition as described above is prepared having a moisture content of 34.0%. Any ingredient added above in liquid form is heated to 70° C., such that the aqueous slurry is never at a temperature below 70° C. At the end of preparation, the aqueous slurry is heated to 80° C. and pumped under pressure ($5\times10^6 Nm^{-2}$), into a counter current spray-drying tower with an air inlet temperature of from 290° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 2.0 wt %, a bulk density of 310 g/l and a particle size distribution such that greater than 90 wt % of the spray-dried powder has a particle size of from 150 to 710 micrometers. The composition of the spray-dried powder is given below.

Spray-dried powder composition.

| Component | % w/w Spray Dried Powder |
|---|---|
| Linear alkyl benzene sulphonate | 15.8 |
| Acrylate/maleate copolymer | 6.8 |
| Ethylenediamine disuccinic acid and/or Hydroxyethane di(methylene phosphonic acid) | 2.1 |
| Sodium carbonate | 28.7 |

-continued

Spray-dried powder composition.

| Component | % w/w Spray Dried Powder |
|---|---|
| Sodium sulphate | 42.4 |
| Water | 2.0 |
| Miscellaneous, such as magnesium sulphate, brightener, and one or more stabilizers | 2.2 |
| Total Parts | 100.00 |

Preparation of an Anionic Surfactant Particle 1.

The anionic detersive surfactant particle 1 is made on a 520 g batch basis using a Tilt-A-Pin then Tilt-A-Plow mixer (both made by Processall). 108 g sodium sulphate supplied is added to the Tilt-A-Pin mixer along with 244 g sodium carbonate. 168 g of 70% active $C_{25}E_3S$ paste (sodium ethoxy sulphate based on $C_{12/15}$ alcohol and ethylene oxide) is added to the Tilt-A-Pin mixer. The components are then mixed at 1200 rpm for 10 seconds. The resulting powder is then transferred into a Tilt-A-Plow mixer and mixed at 200 rpm for 2 minutes to form particles. The particles are then dried in a fluid bed dryer at a rate of 2500 l/min at 120° C. until the equilibrium relative humidity of the particles is less than 15%. The dried particles are then sieved and the fraction through 1180 μm and on 250 μm is retained. The bulk density of the anionic detersive surfactant particle 1 is 900 g/l. The composition of the anionic detersive surfactant particle 1 is as follows:

25.0% w/w $C_{25}E_3S$ sodium ethoxy sulphate
18.0% w/w sodium sulphate
57.0% w/w sodium carbonate Preparation of a Granular Laundry Detergent Composition.

The spray-dried powder of example 1, the anionic detersive surfactant particle 1 and other individually dosed dry-added materials are combined to form a granular laundry detergent composition. The formulation of the granular laundry detergent composition is described below:

A granular laundry detergent composition.

| Component | % w/w granular laundry detergent composition |
|---|---|
| Spray-dried powder of example 1 | 73.0 |
| Sodium percarbonate (having from 12% to 15% active AvOx) (bulk density of 980 g/l) | 12.0 |
| Enzymes (bulk density of 1,100 g/l) | 0.5 |
| Tetraacetyl ethylene diamine agglomerate (92 wt % active) (bulk density of 485 g/l) | 1.0 |
| Suds suppressor agglomerate (11.5 wt % active) (bulk density of 700 g/l) | 0.5 |
| Anionic detersive surfactant particle 1 (bulk density of 900 g/l) | 10.0 |
| Miscellaneous | 3.0 |
| Total Parts | 100.00 |

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A solid laundry detergent composition having a bulk density of from about 100 g/l to 500 g/l, wherein the composition comprises:

(a) from about 1 wt % to about 70 wt % anionic detersive surfactant;

(b) from about 0 wt % to about 10 wt % zeolite builder; and (c) from about 0 wt % to about 10 wt % phosphate builder;

wherein the composition comprises:

(I) from 70 wt % to about 90 wt % low-density particulate component, wherein the low-density particulate component has a bulk density of from about 100 g/l to about 400 g/l and wherein the low-density particulate component comprises inorganic and organic material; and (II) from about 10 wt % to 30 wt % high-density particulate component, wherein the high-density particulate component has a bulk density of from 600 g/l to about 5,000 g/l, and wherein the high-density particulate component comprises:

a first discrete population of homogeneous high-density particles comprising an ethoxylated alcohol sulphate anionic detersive surfactant co-granulated with sodium sulphate and sodium carbonate; and a second discrete population of homogeneous high-density particles consisting essentially of sodium percarbonate at least partially coated by a coating material;

wherein:

the weight ratio of the inorganic material to the organic material in the low-density particulate component (I) defines a low-density particulate ratio;

the weight ratio of the inorganic material to the organic material in the solid laundry detergent composition defines a total-composition ratio;

the low-density particulate ratio is from 0.3:1 to 5:1;

the total-composition ratio is from 0.3:1 to 1.5:1; and the ratio of the low-density particulate ratio to the total-composition ratio is from 0.3:1 to 5:1.

2. A composition according to claim 1, wherein the composition comprises from about 0 wt % to about 5 wt % silicate salt.

3. A composition according to claim 1, wherein the composition comprises:

(i) from 70 wt % to 85 wt % of the low-density particulate component (I); and (ii) from 15 wt % to 30 wt % of the high-density particulate component (II).

4. A composition according to claim 1, wherein the composition has a bulk density of from about 300 g/l to 400 g/l.

5. A composition according to claim 2, wherein the composition comprises (i) 0 wt % zeolite builder (b);

(ii) 0 wt % phosphate builder (c); and (iii) 0 wt % silicate salt.

6. A composition according to claim 1, wherein the low-density particulate ratio is from 0:3:1 to 1.2:1, the total-composition ratio is from 0.3:1 to 1.4:1, and the ratio of the low-density particulate ratio to the total-composition ratio is from 0.3:1 to 0.6:1.

7. The composition of claim 1, wherein the low-density particulate component comprises a single population of homogeneous spray-dried particles having at least three detergent ingredients per particle.

8. The composition of claim 1, wherein the low-density particulate component comprises 15.8 wt % linear alkyl benzene sulphonate and 42.4 wt % sodium sulphate and has a bulk density of 310 g/l.

9. The composition of claim 1, wherein the ethoxylated alcohol sulphate anionic detersive surfactant has an average ethoxylation degree of from 1 to 10.

10. The composition of claim 1, wherein the coating material is selected from the group consisting of carbonate salts, sulphate salts, silicate salts, borosilicate salts, and mixtures or mixed salts thereof.

11. The composition of claim 1, wherein the high-density particulate component has a bulk density of from about 700 g/l to about 5,000 g/l.

12. The composition of claim 1, wherein the high-density particulate component has a bulk density of from about 800 g/l to about 5,000 g/l.

13. The composition of claim 1, wherein the composition has a bulk density of from about 100 g/l to 400 g/l and the high-density particulate component has a bulk density of from about 800 g/l to about 5,000 g/l.

14. The composition of claim 1, wherein the high-density particulate component has a bulk density of from about 800 g/l to about 5,000 g/l and the low-density particulate component has a bulk density of from about 100 g/l to about 300 g/l.

15. The composition of claim 1, wherein the high-density particulate component has a bulk density of from about 800 g/l to about 5,000 g/l and the low-density particulate component has a bulk density of from about 100 g/l to about 200 g/l.

16. The composition of claim 1, wherein:

the composition comprises from 75 wt % to 85 wt % of the low-density particulate and from 15 wt % to 25 wt % of the high-density particulate;

the high-density particulate component has a bulk density of from about 800 g/l to about 5,000 g/l; and the low-density particulate component has a bulk density of from about 100 g/l to about 300 g/l.

* * * * *